US005520026A

United States Patent [19]

Ackland

[11] Patent Number: 5,520,026

[45] Date of Patent: May 28, 1996

[54] LID SWITCH ACTUATOR

[75] Inventor: Bernard J. Ackland, Mt. Morris, Ill.

[73] Assignee: Honeywell Inc., Minneapolis, Minn.

[21] Appl. No.: 359,785

[22] Filed: Dec. 20, 1994

[51] Int. Cl.[6] ..... D06F 39/14

[52] U.S. Cl. ..... 68/12.26; 192/136; 200/61.62; 292/DIG. 69

[58] Field of Search ..... 68/12.26, 23 R; 134/57 DL, 58 DL; 200/61.62, 61.64, 61.69, 330, 331; 192/136; 292/DIG. 69, 341.15; 70/DIG. 30

[56] References Cited

PUBLICATIONS

Douglas C. Giancoli, *General Physics*, (New Jersey: Prentice–Hall, 1984), 68–72.

Ferdinand P. Beer and E. Russell Johnston, Jr., *Vector Mechanics for Engineers* (New York: McGraw–Hill, 1988), 317–325.

*Primary Examiner*—Philip R. Coe

*Attorney, Agent, or Firm*—Peter J. Kinsella; William D. Lanyi

[57] ABSTRACT

A device is presented which converts longitudinal motion in a first axis to longitudinal motion in a second axis. The device is comprised of a push-rod having an inclined plane. A probe engages the inclined plane causing said push-rod to longitudinally move in the first axis when said probe moves longitudinally in the second axis.

7 Claims, 6 Drawing Sheets

LID SWITCH ACTUATOR

BACKGROUND OF THE INVENTION

1. Field of the Invention

This invention relates generally to switch actuators. More particularly, a device is presented which converts longitudinal motion in a first axis to longitudinal motion in a second axis.

2. Description of the Related Art

Clothes washing machines are typically comprised of a housing, a tub and a lid. Most tubs have a cylindrical shape with an opening at one end. The tub's longitudinal axis is generally positioned vertically within the housing. The open end of the tub is usually on top, thus allowing the deposit and removal of clothing from the tub.

Washing machines generally have at least three operating modes: fill, wash and spin. In fill mode, water is added to the washing machine tub; while in wash mode, the tub is repeatedly rotated in one direction and then in an opposite direction. Most washing machines, while in the spin cycle, rotate the tub in one direction at a very high speed, thereby utilizing the centrifugal force to extract water from the clothes. Typically, the fill, wash and spin cycles are performed at least twice, to ensure that the dirt and any cleaning detergent is removed from the clothing.

Most washing machines are designed to stop tub movement when the lid is lifted. Typically, the lid is in mechanical communication with a switch actuator. The switch is electrically connected to the motor running the tub. Thus, when the lid is lifted, the switch prevents electrical current from flowing to the motor, which, in turn, stops the tub's rotation. The switch is often located on an interior surface of the washing machine housing and displaced a distance from the tub to protect it from water and human contact.

In some washing machines, a form spring is used to mechanically couple the switch to the lid. The form spring typically has a thin cylindrical metal body having a longitudinal axis and two paddles, each paddle radially protruding from each end of the metal body. A first paddle is located proximate to the switch, while a second paddle is located proximate to the lid. Thus, when the lid is closed, a probe causes the first paddle to rotate around the longitudinal access of the body. This motion causes the second paddle to engage the switch actuator, thus allowing energy to pass to the tub motor. Any over-travel by the lid will be absorbed by the spring because of the spring's thin metal body.

Unfortunately, the form spring may either be deformed when originally manufactured or by repeated use. Such a deformed spring can cause the washing machine to stop operating when the lid is, in fact, closed. Such a deformed spring usually requires a service technician to either adjust or replace the spring.

SUMMARY OF THE INVENTION

A device is presented which converts longitudinal motion in a first axis to longitudinal motion in a second axis. A preferred embodiment of the device is comprised of a push-rod having an inclined plane and a probe. The probe engages the inclined plane, causing the push-rod to move longitudinally in the first axis in response to the longitudinal movement of the probe in the second axis.

BRIEF DESCRIPTION OF THE DRAWINGS

The present invention will be more completely understood from a reading of the Description of the Preferred Embodiments in conjunction with the drawings, in which.

DESCRIPTION OF THE PREFERRED EMBODIMENTS

Figure 1:
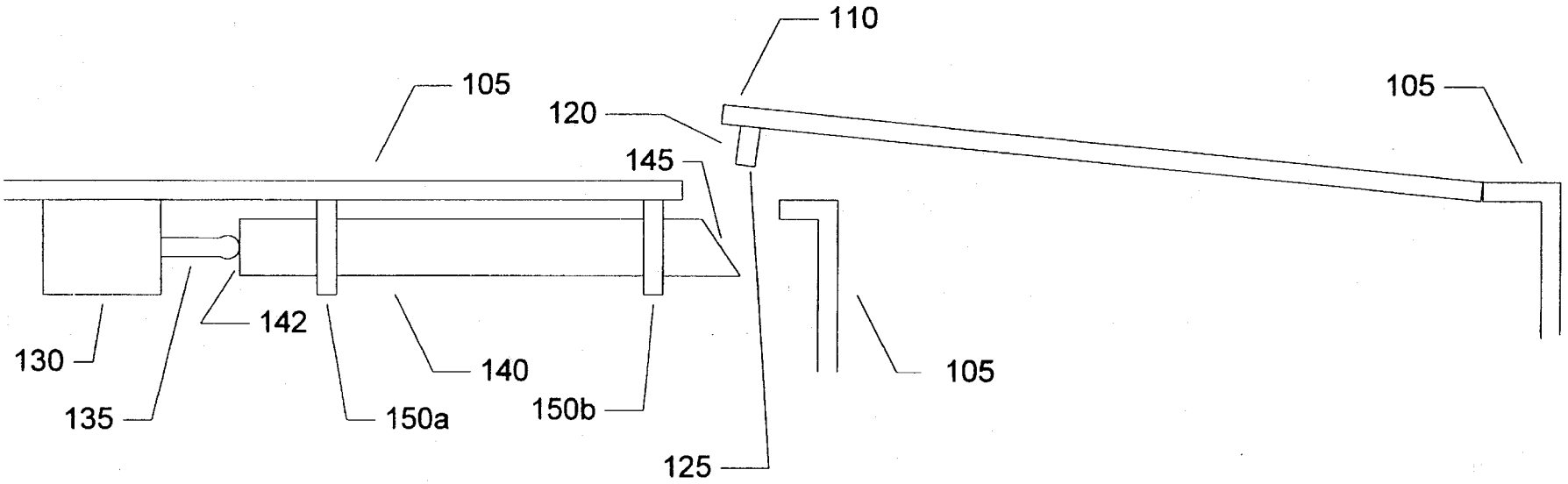
FIG. 1 shows a plan view of a preferred embodiment of the present invention.

FIG. 1 depicts a plan view of a lid switch actuator comprised of a push-rod 140, having an actuating surface 142, which mechanically communicates with an actuator 135 of a normally open switch 130, and an inclined surface 145, which mechanically communicates with a flat probe tip 125 of a probe 120. Push-rod 140 is coupled to a housing 105 by a guide bracket **150*a* and a guide bracket 150*b*. Probe 120 is attached to a mostly square lid 110. Lid 110 is pivotably mounted to housing 105**.

As described, probe 120 moves along an arc. When probe 120 is moved toward inclined surface 145 (e.g. lid 110 is closed), flat probe tip 125 will come into contact with inclined surface 145. Once probe tip 125 has engaged inclined surface 145, any further movement by probe tip 125 will occur mainly along a vertical axis. Thus, further closing lid 110 moves push-rod 140 horizontally toward switch 130, which in turn moves actuator 135 toward switch 130. Switch 130 is electrically connected to a tub motor (not shown). If push-rod 140 is moved a sufficient distance toward switch 130, actuator 135 will close normally open switch 130, thus allowing electrical current to pass to the tub motor.

It should be noted that switch 130 must place a sufficient outward force on actuator 135 to return push-rod 140 to its original position when probe tip 125 is not engaged with inclined surface 145. Thus, when lid 110 is lifted, the force causing push-rod 140 to close switch 130 is removed. This allows actuator 135 to return push-rod 140 to its original position, which in turn opens switch 130. This action stops electricity from flowing to the tub motor. Several switches well-known in the art meet the operational characteristics described herein. One such switch is manufactured and sold by the Micro Switch division of Honeywell and has designation number V7-1C17D8. This particular device requires the actuator to move 50 thousandths of an inch before the switch will close.

Figure 2:
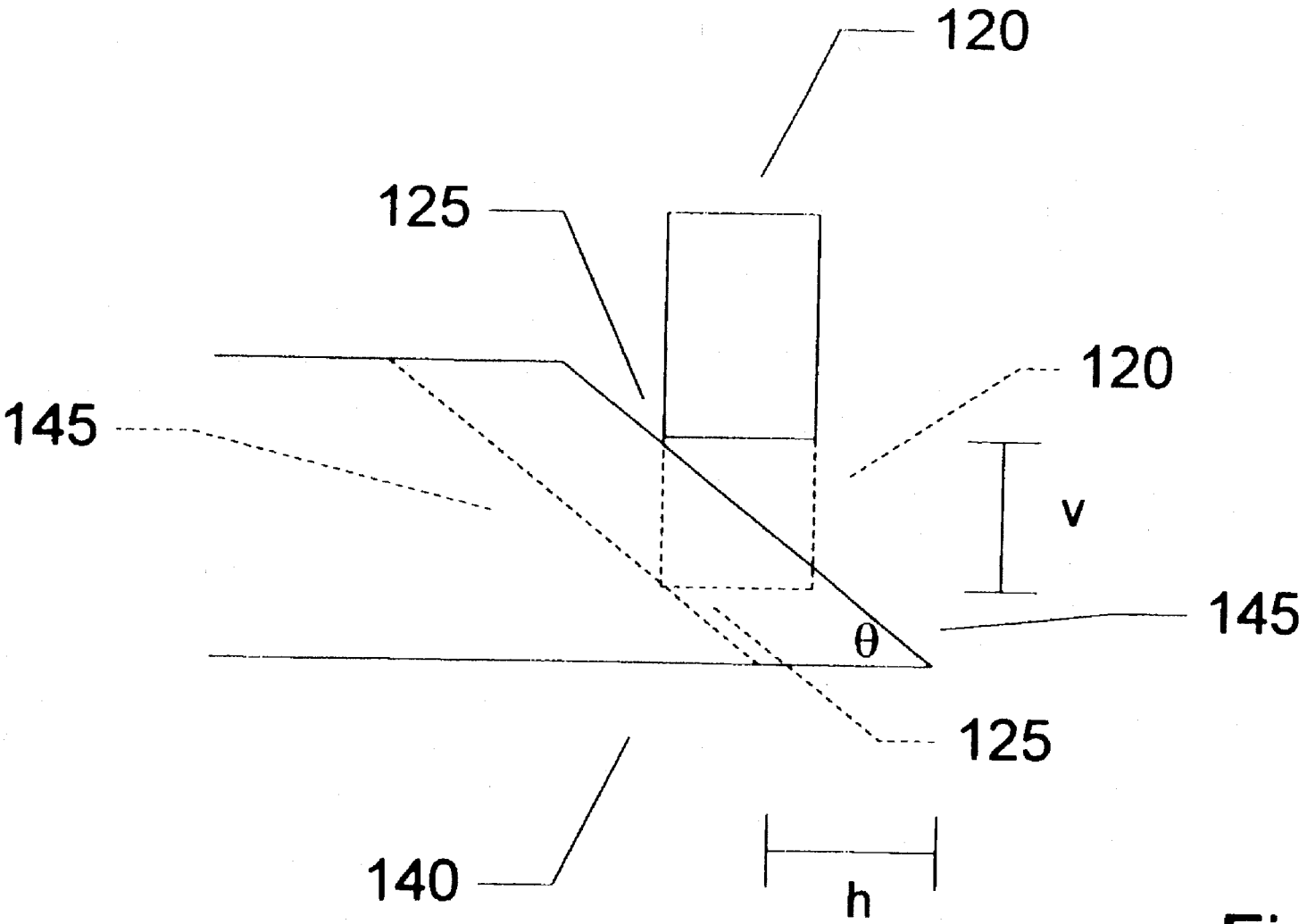
FIG. 2 depicts the position of a push-rod and a probe at two different instances.

FIG. 2 further depicts the horizontal movement push-rod 140 will undergo when probe 120 is moved vertically. Components having the same function as described in FIG. 1 have retained the same numerical identification. In this figure, a solid line denotes the position of the components at a first-time instance, while a dotted line denotes the position of the components at a second-time instance after probe 120 has moved toward push-rod 140.

The horizontal distance travelled by push-rod 140 can be described mathematically as a function of the distance travelled by probe 120 and the angle of the inclined plane, θ. More particularly, $$\tan(90° - \theta) = \frac{h}{v}, \quad \text{(eqn. 1)}$$

where, θ is the angle of the inclined plane (note 0<θ<90°);

h is the horizontal distance travelled by push-rod 140; and v is the vertical distance travelled by probe 120, while engaged with inclined surface 145.

Derived from the above mathematical formula, the horizontal distance push-rod 140 must travel for a given vertical distance travelled by probe 120 and a given value of θ is defined to be:

$$h = \tan(90° - \theta)v \quad \text{(eqn. 2a)}$$

Further, re-writing the above equation provides an equation (eqn. 2b) describing the vertical distance probe 120 must travel for a given horizontal distance travelled by push-rod 140 and a given value of θ.

$$v = \frac{h}{\tan(90° - \theta)} \quad \text{(eqn. 2b)}$$

For example, as previously mentioned, the preferred embodiment of switch 130, depicted in FIG. 1, is designed to close when actuator 135 is depressed 50 thousandths of an inch. If θ is 40°, equation 2b dictates that probe 120 must vertically travel at least 41.955 thousandths of an inch.

One skilled in the art will recognize that, as θ decreases, the horizontal distance travelled by push-rod 140 will increase for any given vertical distance travelled by probe 120. Thus, a small movement by probe tip 125 on an inclined surface 145 having a small θ will produce a larger horizontal displacement than the same movement on an inclined surface 145 having a large θ. Thus, a push-rod 140 having a small value of θ doesn't have to have as much vertical height as a push-rod 140 having a larger value of θ.

The value of θ also determines the amount of force needed to overcome the friction between probe tip 125 and inclined surface 145. The friction between probe tip 125 and inclined plane 145 is typically described as:

$$F_{fr} = u_S F_v \cos\theta, \quad \text{(eqn. 3)}$$

where, $F_{fr}$ is the Force of Friction;

$u_S$ is the static coefficient of friction between probe tip 125 and inclined surface 145; and $F_v$ is the force probe 120 is exerting V axis.

Thus, probe 120 will move push-rod 145 toward switch 135 if:

$$F_v \sin\theta > F_{fr} \quad \text{(Eqn. 4)}$$

By substituting equation 3 into equation 4, the following inequality arises:

$$\tan\theta > u_S \quad \text{(Eqn. 5)}$$

If equation 5 is satisfied, probe 120 will be able to move push-rod 140 toward switch 130. If the angle of θ is too small, probe 120 may be held in place by the friction created between probe tip 125 and inclined surface 145. This problem can be overcome by increasing θ.

The static coefficient of friction, $u_S$, will vary depending on from what material probe 120 and push-rod 145 are constructed. Generally, most materials have a static coefficient of friction between 0.15 and 0.6. Thus, having a value of θ greater than 31° should overcome the friction between most materials that could be utilized in this invention.

It should be noted that high lubricity polymers could also be utilized with this invention. Some of these polymers have a static coefficient of friction as low as 0.01. For those polymers, the value of θ could be as low a 0.6°.

Referring to the previous example, where θ was selected to be 40°, the coefficient of friction must be less than 0.839. It should be noted that the value of θ chosen in the previous example was merely exemplary. Any value of θ can be selected so long as equation 5 is satisfied.

Figure 3:
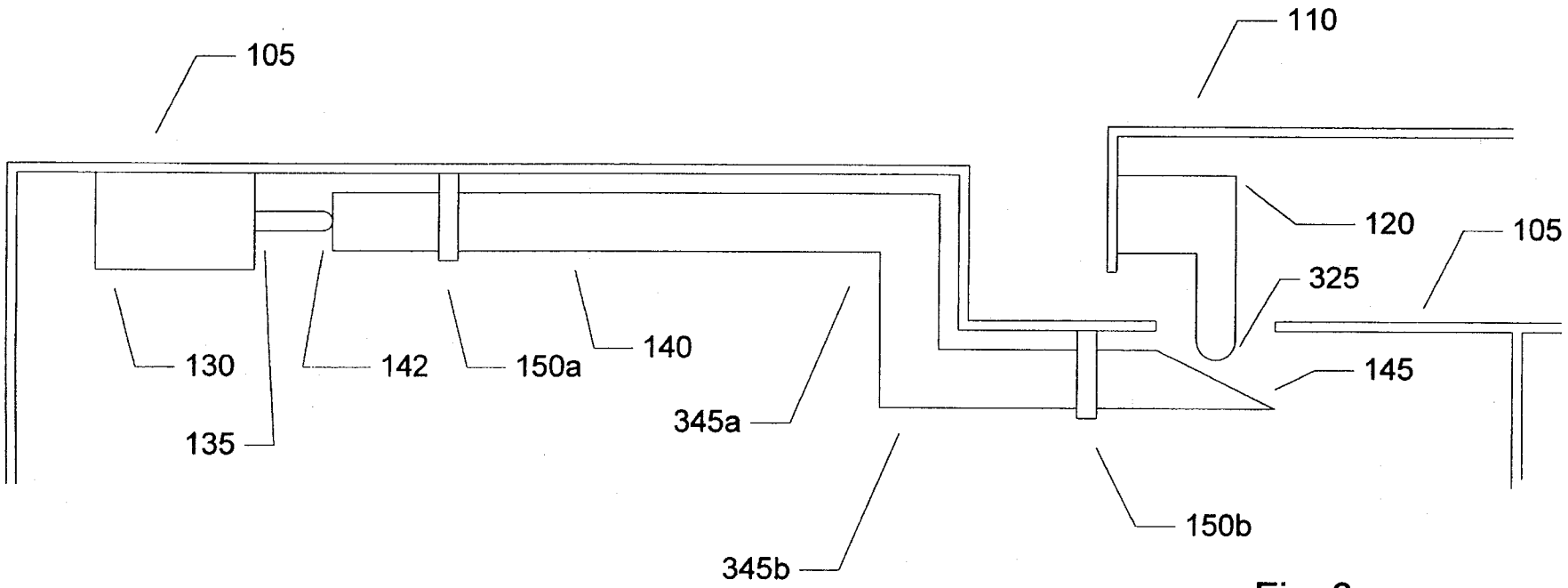
FIG. 3 shows an alternate embodiment of the present invention having over-travel compensation.

FIG. 3 depicts a plan view of an alternate embodiment of a lid switch actuator providing over-travel compensation. Components having the same function as described in the previous figures have retained the same numerical identification. In this embodiment, push-rod 140 is further comprised of two L-shaped segments 345*a* and 345*b*, while probe 120 has a rounded probe tip 325.

As probe 120 is moved downward, rounded probe tip 325 engages inclined surface 145 of push-rod 140. Once rounded probe tip 325 engages inclined surface 145, any further downward movement of probe 120 will cause push-rod 140 to move laterally toward switch 130. When probe 120 has moved a sufficient downward distance to actuate switch 130, actuator 135 will resist any further lateral movement. If push-rod 140 is constructed out of a flexible material, such as a plastic, any further downward movement of probe 120 will cause L-shaped segments 345*a* and 345*b* to deform without causing excessive force to be applied to actuator 135. This prevents damage to switch 130 if probe 120 is moved past its most maximum downward position.

It should be noted that constructing push-rod 140 out of a plastic material provides several advantages. First, most plastics are insulators. Thus, push-rod 140 electrically isolates switch 130 from lid 110. Second, most plastics have a low static coefficient of friction. This allows probe 325 and inclined surface 145 to mechanically communicate without excessive wear. This property also allows push-rod 140 to slide in guide brackets 150*a* and 150*b* without requiring additional lubrication. Third, molding a device out of plastic is an easy and inexpensive process. Finally, plastic does not corrode. This is especially important when this apparatus is used in a humid environment, such as a washing machine.

As described in this embodiment, rounded tip 325 is less likely to gouge inclined surface 145 when compared to flat tip 125, as described in FIG. 1. Thus, rounded tip 325 will extend the life of push-rod 140 and is unlikely to be disturbed by small variations in the surface of inclined surface 145.

It should also be understood that L-shaped segments 345*a* and 345*b* allow switch 130 to be positioned anywhere within housing 105. This is particularly advantageous in housings 105 having a complex shape.

Figure 4:
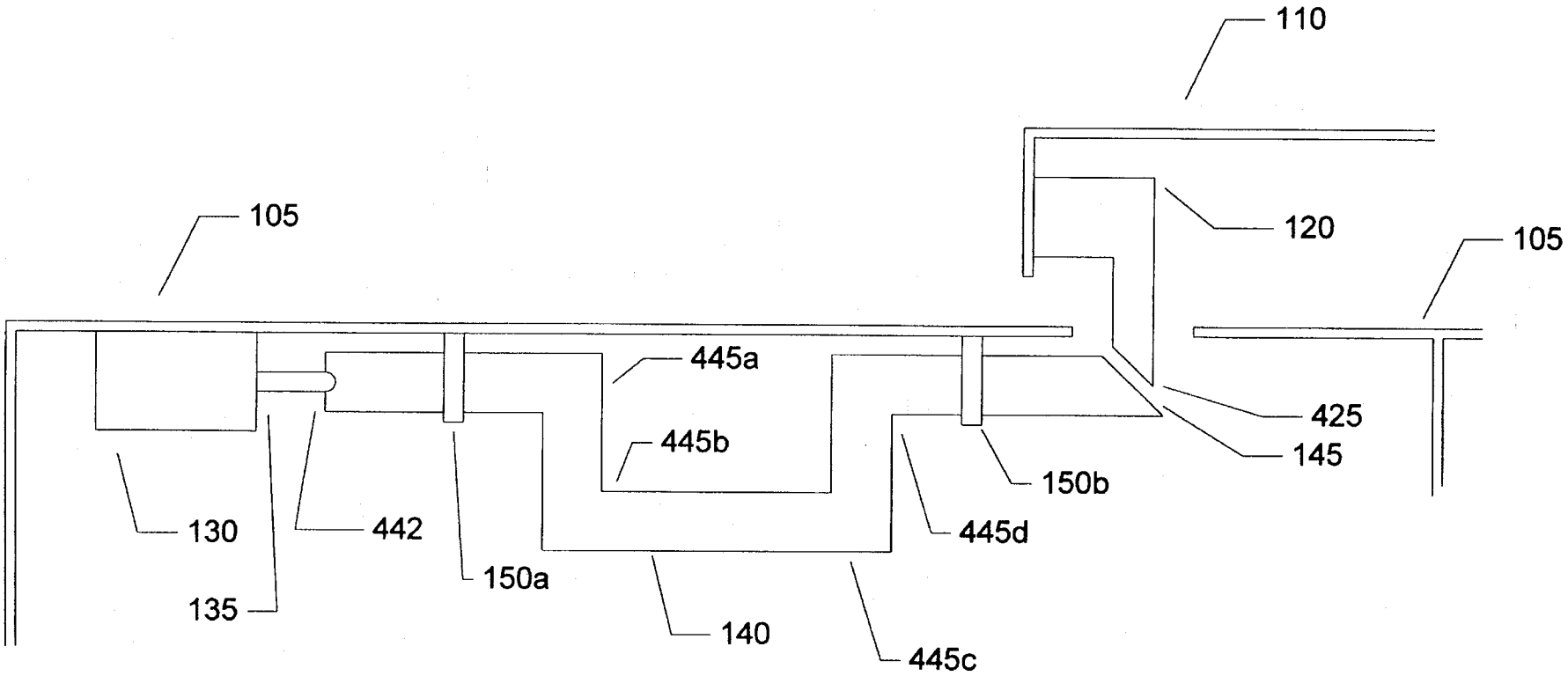
FIG. 4 depicts a plan view of an alternate embodiment of the present invention providing over-travel compensation.

FIG. 4 depicts a plan view of an alternate embodiment of a lid switch actuator providing over-travel compensation. Those components having the same function as in the previous figures have retained the same numerical identification.

In this embodiment, push-rod 140 is further comprised of four L-shaped segments, 445*a*, 445*b*, 445*c* and 445*d*, and a shaped actuating surface 442, while probe 120 has an inclined probe tip 425.

The operation of this embodiment will now be described. As probe 120 is moved in a downward direction, inclined probe tip 425 engages inclined surface 145 of push-rod 140. Once inclined probe tip 425 engages inclined surface 145, any further downward movement of probe 120 will cause push-rod 140 to move horizontally toward switch 130. When probe 120 has moved a sufficient downward distance to actuate switch 130, actuator 135 will resist any further lateral movement. If push-rod 140 is constructed out of a flexible material such as a plastic, further downward movement of probe 120 will cause L-shaped segments 445*a*, 445*b*, 445*c* and 445*d* to deform, thus preventing excessive force from being applied to actuator 135.

Shaped actuating surface 442 allows push-rod 140 to be deformed by excessive pressure without losing contact with actuator 135. This feature further prevents switch 130 from opening when lid 110 is closed.

Inclined probe tip 425 permits a large portion of the probe 120 to be in simultaneous contact with push-rod 140. This distributes the force from lid 110 over a large portion of inclined surface 145, thus reducing the chance of gouging inclined surface 145.

Figure 5:
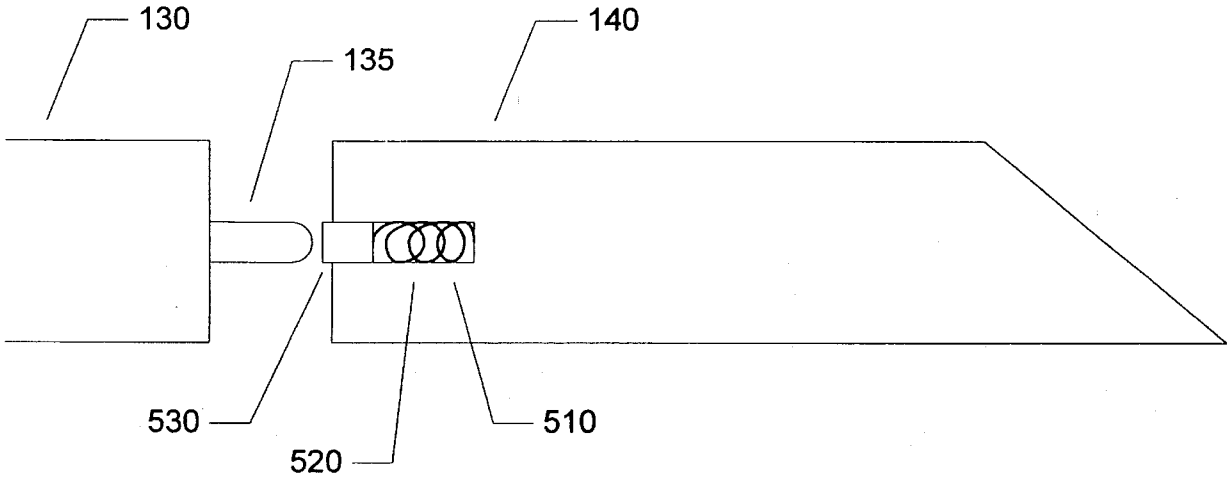
FIG. 5 depicts a plan view of an alternate embodiment of the present invention providing over-travel compensation.

FIG. 5 depicts a plan view of an alternate embodiment of a lid switch actuator providing over-travel compensation. Those components having the same function as in the previous figures have retained the same numerical identification. In this embodiment, push-rod 140 has a cavity 510, which contains a coiled spring 520 and a plunger 530.

As push-rod 140 to moves toward switch 130, plunger 530 engages actuator 135. Spring 520 is designed to have a greater compression force than the force needed to actuate actuator 135. Once push-rod 140 has moved a sufficient distance to actuate switch 130, actuator 135 will resist any further lateral movement. This causes spring 520 to compress, thus absorbing any over-travel of push-rod 140.

Figure 6:
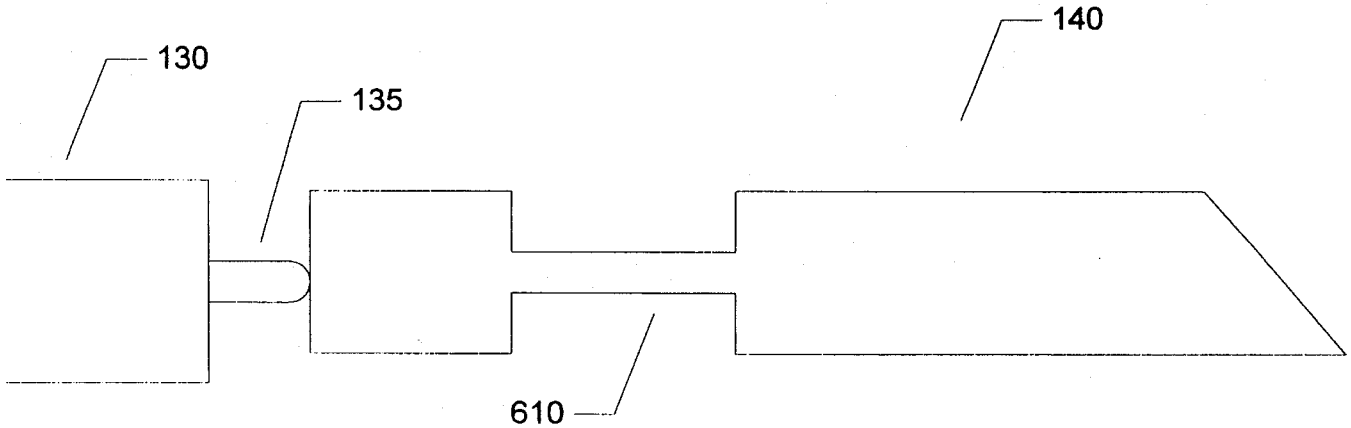
FIG. 6 depicts a plan view of an alternate embodiment of the present invention providing over-travel compensation.

FIG. 6 depicts a plan view of an alternate embodiment of a lid switch actuator providing over-travel compensation. Those components having the same function as in the previous figures have retained the same numerical identification. In this particular embodiment, push-rod 140 has a narrow region 610.

As previously described, once push-rod 140 has moved a sufficient distance to actuate switch 130, actuator 135 will resist any further lateral movement. Any further movement of push-rod 140 toward switch 130 will cause narrow region 610 to deform, thus absorbing any over-travel of push-rod 140.

Figure 7:
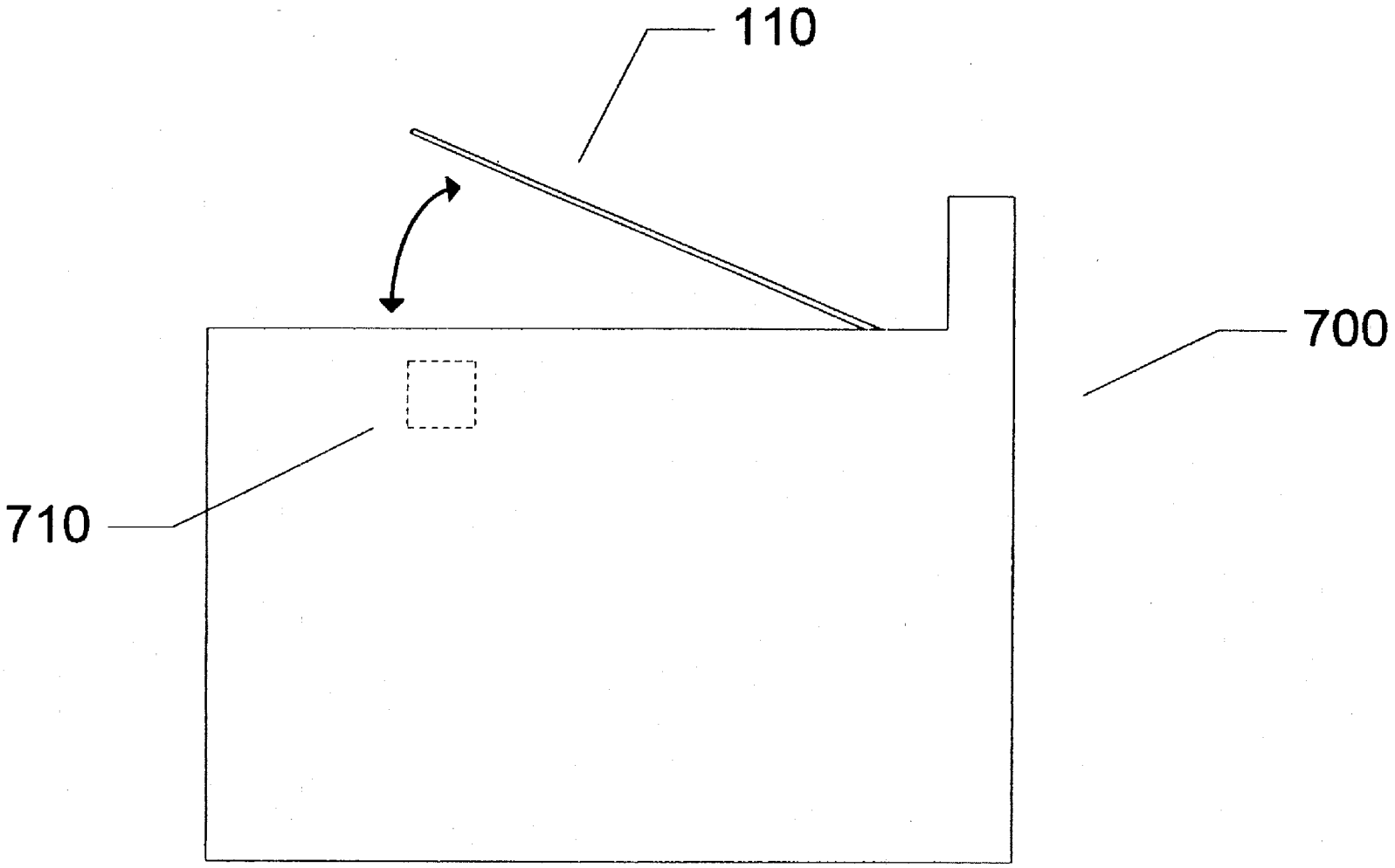
FIG. 7 depicts a plan view of a device having the present invention.

FIG. 7 depicts a plan view of a device having the present invention. Those components having the same function as in the previous figures have retained the same numerical identification. In this figure, a dashed box 710, generally describes the position of a lid switch actuator, constructed in accordance with the present invention, with respect to a machine 700 and lid 110. Although dashed box 710 has been depicted at a specific location within machine 700, one skilled in the art will recognize that the lid switch actuator described herein can be located anywhere within machine 700, so long as it is near lid 110. In the preferred embodiment, machine 700 can take the form of any appliance, particularly a washing machine. It should be noted, however, that any machine having a lid can utilize the invention described herein.

Although the present invention has been described with reference to preferred embodiments, those skilled in the art will recognize changes that may be made, in form or detail, without departing from the spirit and scope of this invention. More precisely, the preferred embodiments have described particular probe tips with particular push-rods. One skilled in the art will recognize that any probe tip can be used with any push-rod configuration.

Moreover, probe 120 has been described as moving mainly in a vertical direction, while push-rod 140 has been described as moving mainly in a horizontal direction. One skilled in the art will recognize that any two axes can be utilized as long as they share a common plane. Thus, the longitudinal motion of probe 120 in a first axis can cause push-rod 140 to move longitudinally in a second axis.

I claim:

1. A switch actuating system for an appliance, said system comprising:

a switch attached to a housing structure of said appliance, said switch having a switch actuator, said switch being actuatable by a movement of said switch actuator along a first axis from a first position of said switch actuator to a second position of said switch actuator;

a push-rod slideably attached to said housing structure, said push-rod having a first end and a second end, said first end having an actuating surface, said second end having an inclined surface;

a probe attached to a lid of said appliance, said lid being movably attached to said housing structure of said appliance, said probe having a probe tip which is movable along a second axis into contact with said inclined surface of said second end of said push-rod in response to movement of said lid toward a closed position relative to said housing structure of said appliance, said inclined surface being shaped to convert said movement of said probe tip along said second axis into movement of said actuating surface of said push-rod along said first axis; and means for returning said switch actuator from said second position to said first position in response to movement of said probe tip along said second axis away from said inclined surface.

2. The device as recited in claim 1, wherein the probe tip is flat.

3. The device as recited in claim 1, wherein the probe tip is inclined.

4. The device as recited in claim 1, wherein the push-rod is comprised of four L-shaped segments.

5. The device as recited in claim 1, wherein said push-rod further comprises:

a cavity formed within said push-rod;

a plunger, slidably mounted within said cavity, for engaging the actuator; and a spring mounted within said cavity, said spring compressing if said push-rod is moved in the first direction after the actuator has been actuated.

6. The device as recited in claim 1, wherein said push-rod has a narrow region which will deform once the actuator has been actuated if said push-rod moves any further in the first direction.

7. The system of claim 1, wherein:

said returning means comprises a spring within said switch.

* * * * *